US005150984A

United States Patent [19]

Bowman et al.

[11] Patent Number: 5,150,984

[45] Date of Patent: Sep. 29, 1992

[54] STIFFENING FLANGES FOR DEFORMATION RESISTANCE OF MANHOLE COVER SUPPORT

[75] Inventors: Harold M. Bowman, Fairview Park; George T. Fuller, Chagrin Falls, both of Ohio

[73] Assignee: Harold M. Bowman, Fairview Park, Ohio

[21] Appl. No.: 846,518

[22] Filed: Mar. 4, 1992

Related U.S. Application Data

[63] Continuation-in-part of Ser. No. 596,255, Oct. 12, 1990, Ser. No. 366,177, Jun. 13, 1989, Pat. No. 4,969,771, Ser. No. 362,257, Jun. 6, 1989, Pat. No. 4,963,053, Ser. No. 362,216, Jun. 6, 1989, Pat. No. 4,966,489, Ser. No. 536,691, Jun. 12, 1990, abandoned, and Ser. No. 560,184, Jul. 31, 1990, abandoned.

[51] Int. Cl.[5] ..... E02D 29/14

[52] U.S. Cl. ..... 404/26

[58] Field of Search ..... 404/25, 26; 52/20; 49/41; 411/516-517, 520-521, 352-352

[56] References Cited

U.S. PATENT DOCUMENTS

| | | | |
|---|---|---|---|
| 1,758,515 | 5/1903 | Heiermann . | |
| 1,908,909 | 6/1905 | McCoy . | |
| 2,595,787 | 5/1952 | Heimann . | |
| 3,701,303 | 10/1972 | Kondo . | |
| 3,858,899 | 1/1975 | Larsson et al. . | |
| 3,891,337 | 5/1975 | Manz . | |
| 4,097,171 | 6/1978 | Fier . | |
| 4,225,226 | 9/1980 | Fier . | |
| 4,269,248 | 5/1981 | MacLean et al. | 411/402 X |
| 4,302,126 | 11/1981 | Fier . | |
| 4,582,450 | 4/1986 | Neil . | |
| 4,614,065 | 9/1986 | Papp . | |
| 4,764,069 | 8/1988 | Reinwall et al. | 411/401 X |
| 4,867,601 | 9/1989 | Bowman | 404/26 |
| 4,927,290 | 5/1990 | Bowman | 404/26 |
| 4,987,650 | 1/1991 | Eickmann . | |

FOREIGN PATENT DOCUMENTS

| | | |
|---|---|---|
| 3910887 | 5/1990 | Fed. Rep. of Germany . |
| 0434471 | 2/1949 | Italy . |
| 0013125 | 11/1941 | Sweden . |
| 0886005 | 1/1962 | United Kingdom . |

*Primary Examiner*—Ramon S. Britts
*Assistant Examiner*—Nancy P. Connolly
*Attorney, Agent, or Firm*—Watts, Hoffman, Fisher & Heinke

[57] ABSTRACT

An improvement for increasing the resistance of manhole cover supports to deformation is provided which comprises equipping the upper edge or flange thereof with a succession of pressed-in gussets, the troughs of which slope with respect to the keeper of said cover support or equipping a keeper wall thereof with a succession of pressed-out gussets.

18 Claims, 3 Drawing Sheets

STIFFENING FLANGES FOR DEFORMATION RESISTANCE OF MANHOLE COVER SUPPORT

REFERENCE TO OTHER APPLICATIONS

This patent application is a continuation-in-part of the following patent application Ser. Nos. 07/596,255 filed Oct. 12, 1990, "entitled Split-Ring Manhole Cover Support", 07/366,177 filed Jun. 13, 1989, entitled "Manhole Cover Support Having Enhanced Grip" now U.S. Pat. No. 4,969,771; 07/362,257 filed Jun. 6, 1989, entitled "Multicomponent Wales and Bases for Manhole Cover Supports" now U.S. Pat. No. 4,963,053; 07/362,216 filed Jun. 6, 1989, entitled "Manhole Cover Support Having Interbraced Top Members" now U.S. Pat. No. 4,966,489; and 07/536,691 filed Jun. 12, 1990, entitled "Manhole Cover Support With Spanners" now abandoned; and it is also a continuation-in-part of application Ser. No. 07/560,184 filed Jul. 31, 1990, entitled "Support for a Catch Basin Cover," now abandoned. It also is related to the following U.S. Pat. Nos. 4,834,574, 4,867,600, 4,867,201, 4,872,780 and 4,927,290. The teachings of these applications and patents are incorporated herein by reference.

BACKGROUND OF THE INVENTION

This invention relates to improved stiffening means in manhole cover supports, that provide greater resistance to deformation and displacement occurring during and after installation of such cover supports into the existing manhole cover receiving structure, such as a manhole frame. The improvement of the invention is particularly suitable for those manhole cover supports that are expandable to provide a vastly improved grip against the housing of the manhole cover receiving structure. These manhole cover supports include split-rings, segmented rings and segmented rectilinear frames.

For simplicity the term "existing manhole cover receiving structure" is used here to refer to the existing, i.e., fixed in-place frame or other seating receptacle for a removable cover or grating that covers an access hole (i.e., hand hole, tool hole, manhole, catch basin or the like). The term "manhole cover" is used in this application to refer to a removable cover or grating over the access hole. The resulting assembly of a receiving structure and a manhole cover ordinarily is intended to bear vehicular traffic. The term "manhole cover support" or simply "cover support" here means a structure that fits over the existing manhole cover receiving structure, raises its grade, and thereby accommodates a cover or grating at the new elevated grade. The access hole covered usually is a utility enclosure serving, e.g., an electric, gas, water, sewer or storm drainage system.

The preponderance of manholes are circular (in street plan), have circular covers and have existing cover-receiving structures such as frames that have circular access holes, circular sills to support the cover, and circular lateral cover keepers (the latter also sometimes termed "collars"). Still others are polygonal, typically rectangular, in nature. In either case, it is desirable to increase the resistance of the cover support, in particularly the top of the cover support, from deformation. Accordingly,, this specification is directed to all manhole cover supports that have ring-like or polygonal, e.g., rectangular, annular elements which are adapted to interact with an existing cover-receiving structure.

Ordinarily a cover support finds its use when a roadway such as a street or highway is resurfaced with an added layer of paving material or repaved, typically with asphalt, concrete or sheet asphalt, to establish a higher grade than immediately before. A principal use for the instant cover support is expected to be in a municipality where axle loads up to 18,182 kg. may have to be resisted by many of these cover supports (as well as serious impact loads from vehicles and snow plows plus a variety of temperature effects, steam leaks,, spillage, etc.) without permitting a hazardous dislocation of the cover support or its cover. Often it is desirable also to cushion the cover for resisting wear or reducing noise, and/or to seal the cover and its cover support against a substantial and possibly overloading infiltration of surface water, e.g., storm drainage that otherwise would enter a sanitary sewer system at various manhole locations.

While the improvement of the invention applies to any manhole cover support, adjustability of the cover support in peripheral dimension and height is desirable for accommodating the wide range of specifications to be met. Consequently, the improvement of the invention is particularly advantageous for adjustable split-ring cover supports such as those disclosed in the parent application U.S. Ser. No. 07/596,255 filed Oct. 12, 1990, and also for adjustable rectangular and segmented ring manhole cover supports such as those disclosed in U.S. Pat. Nos. 4,966,489, 4,872,780, and 4,867,600 all of which are incorporated herein by reference.

The conventional split ring cover support today has a base ring that is practically uniform in its cross section. Perhaps the least expensive manhole cover support for a circular manhole is a conventional split-ring cover support like the one invented by A. H. R. McCoy. It is disclosed in U.S. Pat. No. 3,891,337 of Jun. 24, 1975, and shows a screw-operated expansion joint, the screw working against the reaction of an abutment projecting from the inside of the base ring. Related supports with various sorts of joint expander means for the split base ring have been developed since then, e.g., the Fier U.S. Pat. Nos. 4,097,171; 4,225,226; and 4,302,126 which show a conventional turnbuckle acting on pivotal eye bolts for the expansion joint and some lever-operated expansion joints, i.e., ones with a spreading link or a pivotally-mounted spreading toggle mechanism.

Segmented ring supports typified by U.S. Pat. No. 4,872,780 have at least on adjustable joint, provided with a spreader means such as a turnbuckle bolt to forcibly engage the housing of the manhole frame structure. The non-adjustable cover support structure of said patent is also significantly improved by the instant invention.

A typical rectangular support has gaps between opposing ends of the base portions that constitute the "sides" of the rectangle. Typically the gaps are at the corners to form adjustable joints between oblique mitered ends of the "sides". The joints include spreader means, such as a turnbuckle, for manipulating the peripheral dimension and base pressure against the reaction surfaces such as the surfaces of the existing collar or receiving element.

Operable service conditions include installing, adjusting, loading, unloading and otherwise handling manhole cover supports and removing the covers therefrom usually is done with powerful and indelicate tools such as picks, pinch bars, crowbars and the like. Deformation of the cover support can occur, particularly about its upper edge which is nearest the road surface. Also, the upper edge is usually the handiest area for applying tools and lifting forces. Deformations along the top are disadvantageous and render the opening of the support unfit for service. Hence, stiffness and resistance against deformation are primary concerns. The wheel loadings caused by vehicle traffic is another serious contributor to deformation and displacement of manhole cover supports.

On the other hand, a relatively light construction of the cover support, in comparison to the usual cast iron frame that usually supports the first manhole cover when the paving is laid, also desirable. To avoid sacrificing ruggedness, resistance to deformation and resistance to displacement, the main place for weight reduction is in the lateral keeper cover or in the base of the cover support. Clearly, the economics of manufacture, handling and installation all generally favor a lighter construction. Moreover, in order to accommodate full seating of the manhole cover within the manhole cover support that has been installed into the manhole cover receiving structure, e.g., manhole frame, specific design restrictions as to the thickness of the lateral cover keeper must be maintained. Therefore, a relatively thin wall keeper of the instant invention would normally be comprised of steel and is rarely more than about 0.1 inch (12 ga.) thick and is usually less. Steel keepers in such thin gauges as from 12 to 16 gauge are at times vulnerable to deformation throughout its structure, especially along the top rim of the keeper wall.

The instant invention is directed to improving the resistance of cover supports, particularly the upper edges thereof, to deformation without sacrificing the advantages of lighter construction. More particularly, the instant invention is directed to improving the entire resistance of all manhole cover supports to deformation and displacement caused by service conditions and vehicle traffic which would otherwise limit service life or cause outright failure.

SUMMARY OF THE INVENTION

The instant invention is an improvement in manhole cover supports that are adapted to fit within the existing manhole cover supporting structure to raise the height or grade of the existing manhole cover from a position within said cover supporting structure to a new and higher level and there retaining the manhole cover in a fixed position.

The conventional split-ring, sectional diameter ring or rectangular cover supports all comprise a base that is adapted to fit into and be expanded against the housing elements of the existing cover-supporting structure, the base, having a top that is essentially in one plane for support of the cover, a bottom therebelow that is in another plane, at least one spreadable interruption in its periphery, spreader means for widening said interruption and thereby forcing said base against the restraint of the housing element of said existing cover-supporting structure, and a cover keeper that is connected to and extends upwardly from the outer periphery of the base. The improvement comprises pressed in gusset type stiffener means for selectively stiffening all or a sector of the cover support. Preferably, the gussets are disposed in the upper edge of the base, i.e., the upper edge of the keeper wall, or the flange or wale thereof.

In the case of split-ring cover supports certain sectors are prone, except for said stiffener means, to lose base ring pressure against the housing element when said interruption in the base ring is widened by the spreader means. Stiffness here means resistance to bending, and stiffness of the base ring here means its resistance to bending away from said housing element when the gap in the ring is spread, this resistance being imparted to the base ring by the use of pressed in gussets in the upper edge of the base periphery, i.e., the upper edge of the keeper wall or flange or wale thereof. The gussets may be used in addition to any other stiffening element or elements of the cover support.

In the case of sectional ring and rectangular frame cover supports, stiffness and resistance to bending is typically addressed by the formation of a wale or flange about the upper edge of the periphery as with ring type supports. This is not always adequate and the improvement of the invention may be employed in combination with the flanged or wale stiffening methods to provide superior resistance to deformation.

This it is an object of the invention to provide an improvement in a manhole cover support adapted to raise the grade of a manhole cover from a position of retention by the cover seat element and the housing element of an existing manhole cover-supporting structure to a new and higher level and there retaining it, the manhole cover support comprising a base that is adapted to fit into the housing element of the existing cover-supporting structure, said base having a top that is essentially in one plane for support of the cover, a bottom therebelow that is in another plane, and a cover keeper of, for example, sheet metal that is connected to and extends upwardly from the outer periphery of the base. The improvement for increasing the resistance of the top of the cover support to deformation comprises a flanged outward top on said keeper, the resulting outward bend of said top being equipped with a succession of pressed-in gussets, the troughs of which slope with respect to the keeper. Preferably the base has at least one spreadable interruption in its periphery and spreader means for widening said interruption and thereby forcing said base against the restraint of the housing element of said existing cover-supporting structure.

The gussets constituting the improvement of the invention may be employed with rectangular or ring type manhole cover supports. They may be employed when the flanged upper edge is simply flanged outward with a single substantially orthogonal bend away from said keeper wall, when it is flanged outward and downward with respect to the keeper wall, or when it is flanged outward, downward and then back again toward the keeper wall to form a hollow wale. In the case of a hollow wale, the final wale forming bend of the flange back toward the keeper wall may be substantially orthogonal with respect to the keeper wall to form a square wale, or it may approach the keeper wall substantially more gradually to form a trapezoidal wale. Similarly, the gussets may be pressed or formed into a solid wale.

Alternatively, gussets may be pressed out of the keeper wall itself. These gussets are of pressed out of the keeper wall or a portion thereof and form vertical indentations from the interior surface of the keeper wall outward which run the entire vertical length of the keeper wall or only a portion the vertical length thereof. These can be formed by simply punching or stamping indentations into the keeper wall from the inside out. In a preferred embodiment these gussets are pressed out in the form of a dovetail notch in the keeper wall. The dovetail gusset can be been flattened over its entire vertical length or only a portion of its vertical length may be flattened.

BRIEF DESCRIPTION OF THE DRAWINGS

FIGS. 16, 18 and 20 show partial plan views of dovetail gussets pressed out of the keeper wall wherein the gussets are unflattened, partially flattened and completely flattened relative to the keeper wall, respectively.

FIGS. 17, 19 and 21 show vertical cross sections of the embodiments shown in FIGS. 16, 18 and 20, taken along lines 17—17, 19—19 and 21—21 respectively.

FIGS. 22 and 23 show a partial plan view taken from below a cover support looking upward, and vertical cross section thereof (taken along line 23—23) of non-dovetail pressed out gussets in combination with a flanged top edge.

DETAILED DESCRIPTION OF THE INVENTION

Figure 1:
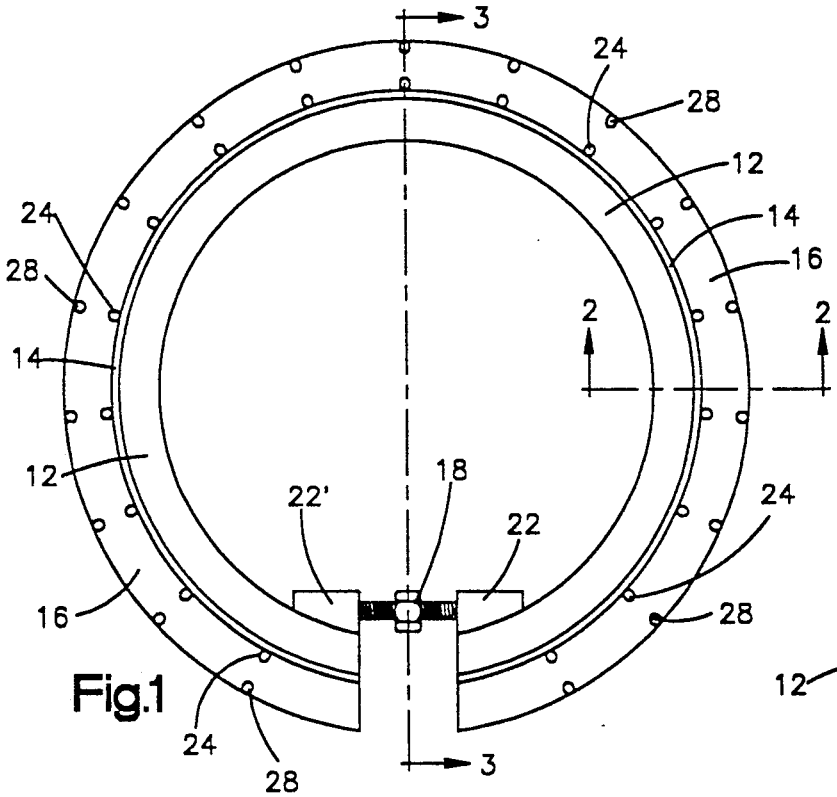
FIG. 1 is a plan view showing the inventive gussets on a split-ring cover support.
Figure 2:
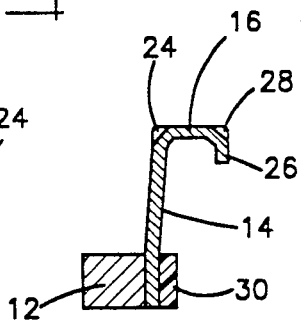
FIG. 2 is a vertical cross section of FIG. 1 taken through section 2—2.
Figure 3:
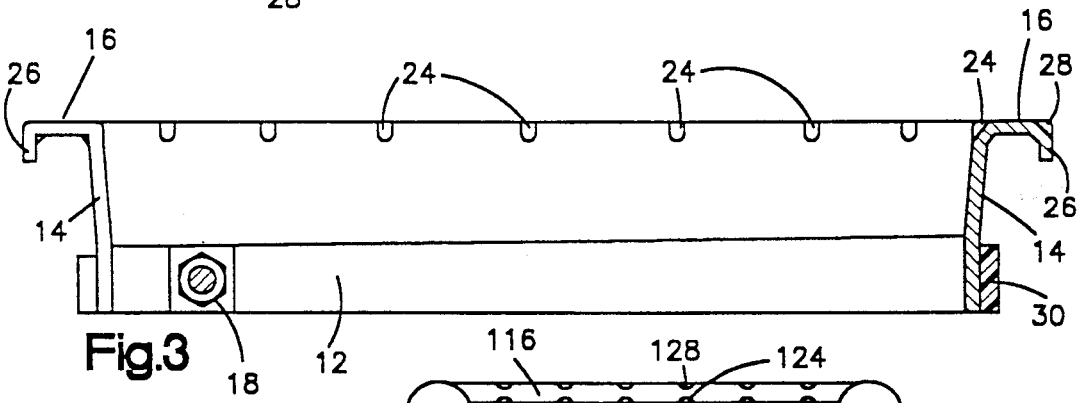
FIG. 3 is a vertical cross section of FIG. 1 taken through section 3—3.

Referring to FIGS. 1-3, a split-ring cover support for a nominally 24-inch diameter manhole cover is shown. Base ring 12 is of cast ductile iron 1 inch high and ¾" wide. Rising from ring 12 and welded thereto is the cover keeper 14 of 13 ga. sheet steel from which extends flange 16.

Adjustment of the periphery of the base ring 12 in a manhole frame (not shown) is down by turning turnbuckle nut 18; it is oppositely threaded into cast ductile iron receivers 22 and 22' to spread out or draw in the gap 20 between the ends of ring 12. Receivers 22 and 22' are of cast ductile iron cast integrally with ring 12. The manhole cover (not shown) is to be seated on the top of base ring 12 and is to be retained laterally by keeper 14. A sealing gasket (not shown) can be used under the cover. The base ring can have conventional elevating screws (not shown) in its bottom to raise the ring or a part of it. Conventional hold-down means (not shown) e.g., a plurality of hooks attached to the inside periphery of the base ring 12 and extending downwards, are to be fastened to a fixed part of the existing manhole construction (such as the hooks drawn up tight under the sill of a manhole frame as is shown in my U.S. Pat. No. 3,773,428).

All around the bend where the top of the keeper 14 is flanged out to make flange 16, seen in FIGS. 1 through 3, there are eighteen substantially evenly-spaced 45°-sloped gussets 24. All around the bend where the lip 26 bends down from flange 16 are eighteen essentially opposed gussets 28 of the same size. To avoid clutter only a few of the gussets 24 and 28 have been representatively numbered. All the gussets are indentations pressed into the 13 ga. sheet steel and are about 0.3" deep inside and about 0.5" long on their inside slants (their troughs). The gussets stiffen and brace the flange and the lip thereon against bending. The sets of gussets do not have to be opposite to each other or always evenly spaced to be functional.

The gussets 24, 28 are typically formed in the stamping process by stamping an indentation in the flat stock material where the gusset is to occur. Of course the gussets may be pressed or stamped in after the flange is formed and in the case of a solid wale, may be stamped into the wale before or after it is welded or otherwise secured to the keeper wall. Conventional stamping and metal working techniques for forming the gussets are known to those of ordinary skill in the art.

FIGS. 2 and 3 are vertical cross sectional of the ring of FIG. 1 taken along lines 2—2 and 3—3 respectively. In these figures, the keeper wall 14 rising from the base ring 12 is depicted as being slightly frustroconical upwards of the base ring 12. However, the keeper wall need not slant outward in this manner and may be simply vertical from the base ring as depicted in FIGS. 5-10, all of which may likewise be slightly frustroconical. The upper edge of the keeper is bent substantially orthogonally from the keeper wall 14 to form flange 16. Flange 16 extends outward and away from the keeper wall and then bends down around its outside edge to form lip 26. The opposing 45°-sloped gussets which are about 0.3" deep inside and about 0.5" long on their inside slants are seen at 24 and 28. Around the outside of ring 12 is seen the optional adhering band 30 of friction-developing material which is an about 1/10-inch thick, flexible, tough baked-on vinyl plastisol about an inch in height.

Figure 4:
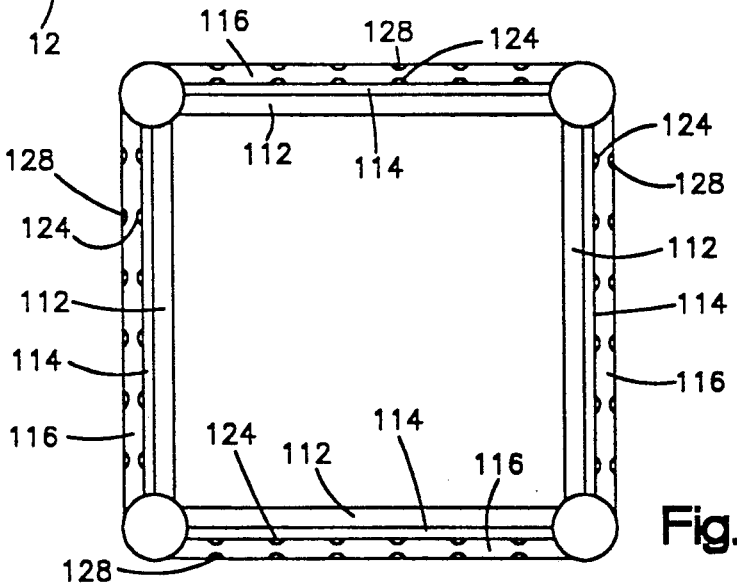
FIG. 4 is a plan view showing the inventive gussets on a rectangular manhole cover support.
Figure 5:
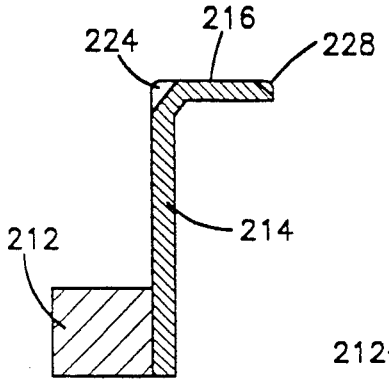
FIGS. 5, 6, 7, 8, 9 and 10 are vertical cross sections of the inventive gussets in conjunction with various flange and wale configurations for either split-ring or rectangular manhole cover supports.
Figure 11:
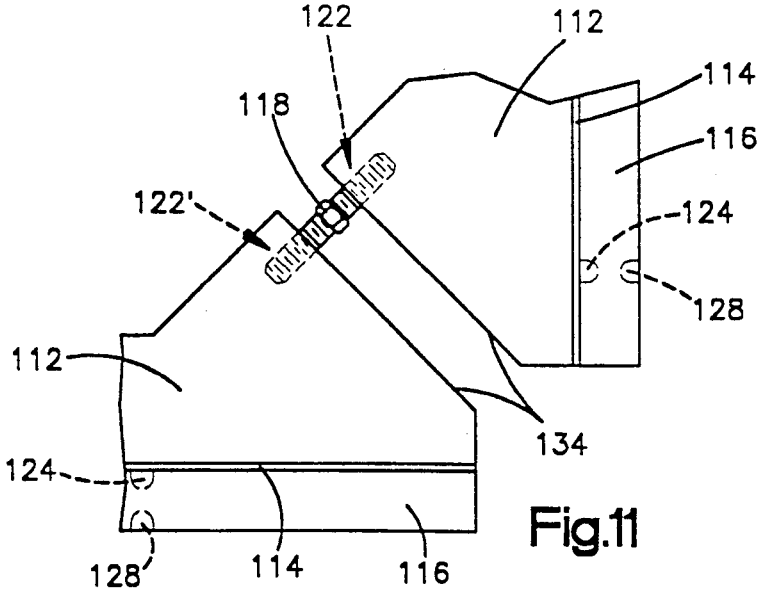
FIG. 11 shows a typical spreader means adapted to an expansible joint for use in a rectangular manhole cover support.
Figure 12:
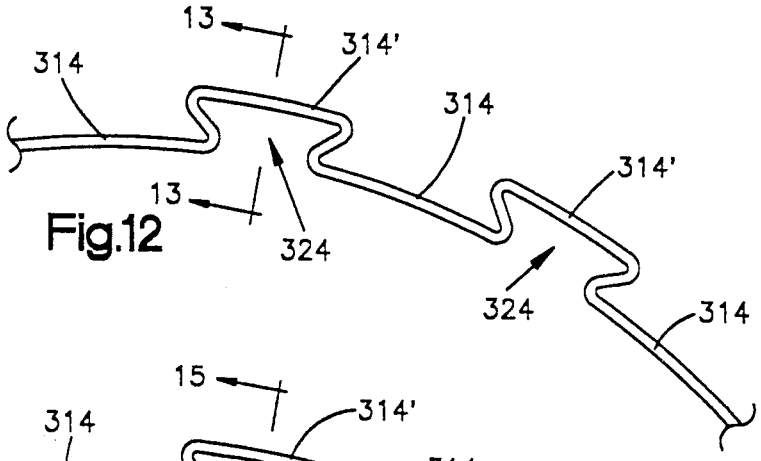
Figure 13:
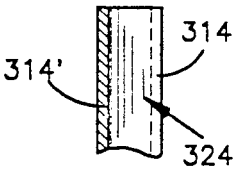
Figure 14:
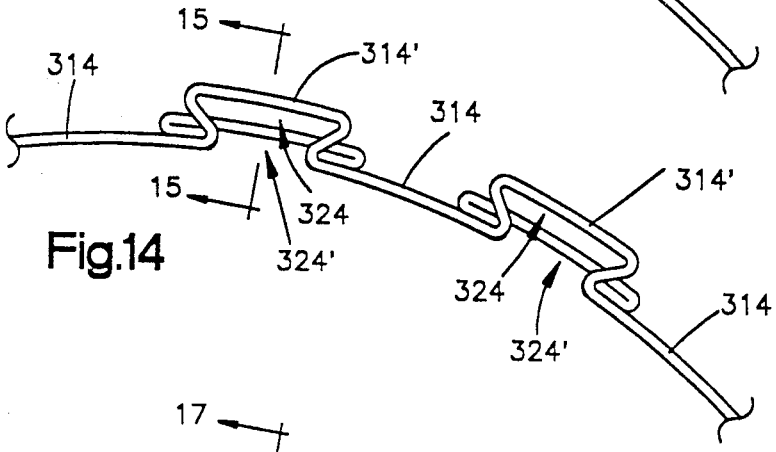
Figure 15:
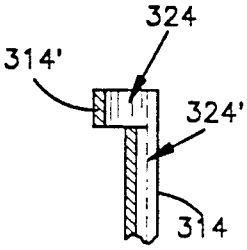

FIG. 4 shows the gussets 124 and 128 as they occur in a rectangular manhole cover support. The rectangular periphery comprises base portions 112 which interface each other at expandable joints J1-J4. Rising substantially vertically from the base portions 112 are keeper walls 114 and extending substantially orthogonally therefrom are flanges 116. The gussets are formed in the flanges at the upper edge of the keeper walls just as they were for the split-ring cover support described above. FIG. 11 depicts a typical expandable joint suitable for placement at J1-J4. The opposing ends 134 of the base portion 112 with the keeper walls 114 and flanges 116 integral therewith, are interconnected by spreader means depicted here as a turnbuckle 118. As in the case of the split-ring cover support described above, the turnbuckle is oppositely threaded into the receiver portions 122 and 122' of the ends 134 of the base portions 112.

Figure 6:
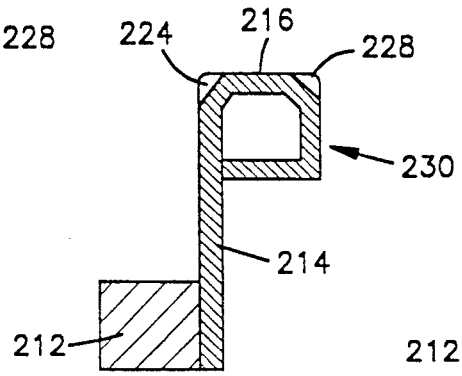
Figure 7:
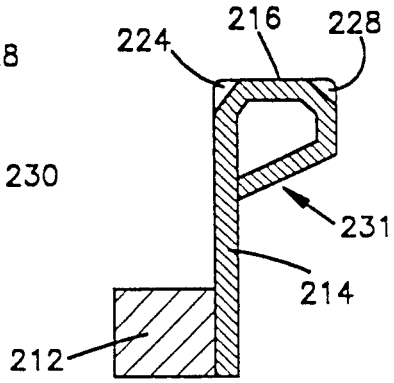
Figure 8:
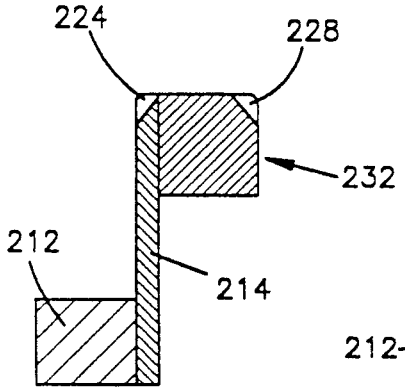
Figure 9:
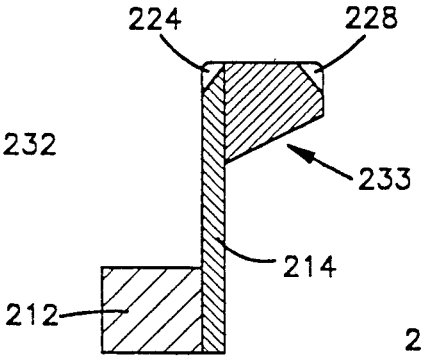
Figure 10:
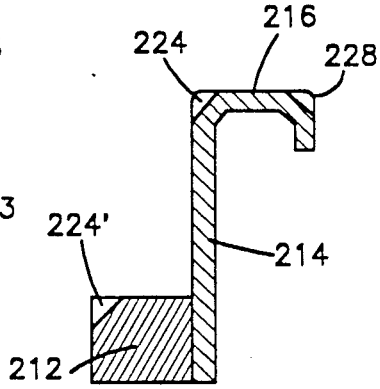

FIGS. 5 through 9 show vertical cross sections consistent with either a rectangular or ring-type manhole cover support. These figures feature the inventive gussets as they occur in various flange and wale configurations suitable for use in the cover supports of the invention. While the keeper wall 214 is depicted as extending substantially vertically from the base 212, it is to be understood that they could also be slightly frustroconical upwards therefrom as depicted in FIG. 2. FIG. 6 shows gussets 224 and 228 formed in a simple strait flange 216 bent substantially orthogonally from the keeper wall 214. FIGS. 6 and 7 show gussets formed in two different hollow wales 230 and 231. The wale depicted in FIG. 7 is particularly advantageous in that during repaving at the raised grade, it enables the pavers to insure that a sufficient amount of asphalt or other paving material is packed in about the cover support and frame. FIGS. 8 and 9 depict the solid wale embodiments 232 and 233 respectively, corresponding to the hollow wales depicted in FIGS. 6 and 7. Solid wales are typically formed separately from the keeper and subsequently welded thereto. Hollow wales may, of course, also be made in this way. FIG. 10 shows that gussets 224' may be pressed into the base ring 212 as well.

Figure 16:
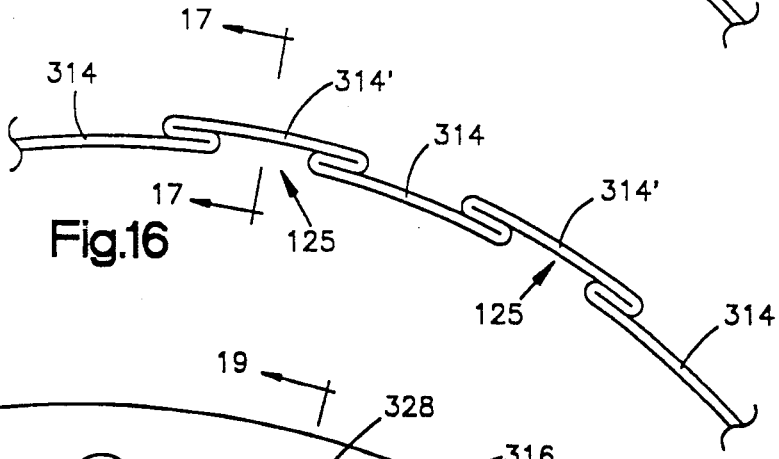
Figure 17:
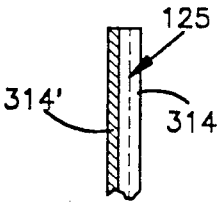
Figure 18:
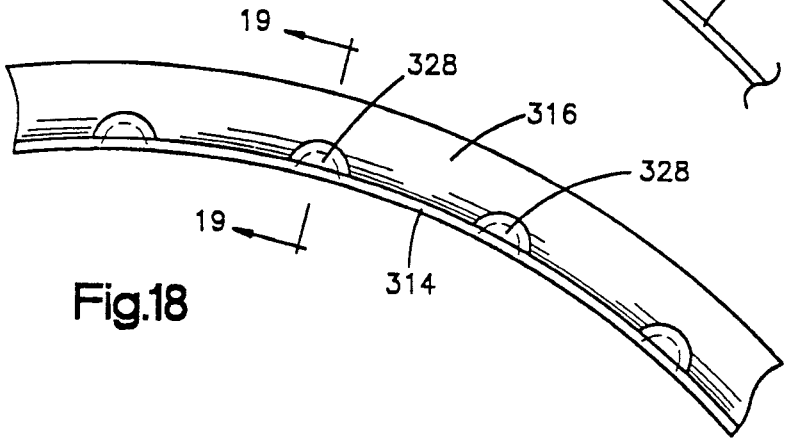
Figure 19:
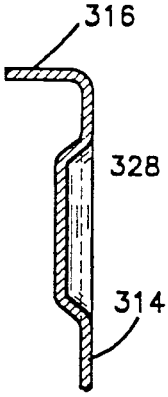

FIGS. 16 through 23 show various embodiments of gussets pressed out of the keeper wall itself. In FIG. 16 a portion of keeper wall 314 has been pressed out to form dovetail gusset portions 324 having outer keeper wall portions 314' which run the entire vertical length of the keeper wall. FIG. 17 shows a vertical cross section thereof taken along line 17—17. In FIG. 18 part of the outer keeper wall portion 314' of the dovetail gusset 324 has been flattened to form flattened dovetail gusset portion 324', while the remaining portion of the dovetail gusset 324 along the upper edge of the keeper wall remains pressed out. FIG. 19 is a vertical cross section of this embodiment taken along line 19—19. In FIGS. 20 and 21 the entire vertical length of the outer keeper wall portion 314' has been flattened to form flattened dovetail gusset 125. FIGS. 22 and 23 show that gussets 328 may be pressed out of the keeper wall and employed in conjunction with an upper flange portion 316 of the keeper. Although not shown, the upper flange portion can include the gussets shown in FIGS. 5–10 for even more strength and resistance to deformation.

The reinforcement induced by the gussets of the invention may be in a particular zone of the cover support requiring extra reinforcement, such as the zone generally opposite the spreader of a split ring, or may be spaced regularly or irregularly about the periphery of the cover support for any level of desired reinforcement.

Suitable materials for frictional components and sealing gaskets for use in conjunction with the manhole cover supports of the invention to increase grip of the support in the existing receiving element or collar or to prevent leakage include flexible, often somewhat elastomeric, sometimes slightly foamed resinous materials such as rubbery polymers, natural rubber (itself a polymer), cork and cork-filled flexible sheeting, asphalt, pitch, various polymers such as polyvinyl chloride (preferably as a baked-on plastisol), polyurethane resins, epoxy resins, styrene-containing polymers such as butadiene-styrene, butyl rubber, polyvinyl acetate-polyethylene-acrylate copolymers, and water-resistant ionomers. Advantageously the Shore A hardness of such material will be between about 20 and about 55 and preferably about 45–55.

Modifications and variations of the invention will be apparent to those skilled in the art in the light of the foregoing detailed disclosure and drawings. Therefore, it is to be understood that, with the scope of the appended claims, the invention can be practiced otherwise than shown and described.

What is claimed is:

1. In a manhole cover support adapted to raise the level of a manhole cover from a position of retention by a cover seat element and a housing element of an existing manhole cover-supporting structure to a new and higher level and there retaining it, the manhole cover support comprising a base that is adapted to fit into the housing element of the existing cover-supporting structure, said base having a top that is substantially in one plane for support of the cover, a bottom therebelow that is in another plane, and a cover keeper of sheet metal that is connected to and extends upwardly from the outer perimeter of the base, the improvement for increasing the resistance of the cover support to deformation which comprises:

a flanged outward top on said keeper, the resulting outward bend of said top being equipped with a succession of pressed-in gussets, the troughs of which slope with respect to the keeper.

2. The improvement according to claim 1 wherein the top of the keeper is flanged outward, then bends downward, and the resulting outward and downward bends are equipped with a succession of pressed-in gussets, the troughs of which slope with respect to the keeper.

3. The improvement according to claim 1 wherein the top of the keeper is flanged outward, then bends downward and then bends back toward the keeper to form a hollow wale wherein the outward and downward bends are equipped with a succession of pressed-in gussets, the troughs of which slope with respect to the keeper.

4. The improvement according to claim 1 wherein the flanged out top is substantially orthogonal with respect to the keeper and the troughs of said gussets slope about 45° thereto.

5. The improvement according to claim 1 wherein the cover support has a rectangular base.

6. The improvement according to claim 1 wherein the cover support has a circular base.

7. In a manhole cover support adapted to raise the level of a manhole cover from a position of retention by a cover seat element and a housing element of an existing manhole cover-supporting structure to a new and higher grade and there retaining it, the manhole cover support comprising a base that is adapted to fit into and be expanded against the housing element of the existing cover-supporting structure, said base having a top that is substantially in one plane for support of the cover, a bottom therebelow that is in another plane, at least one spreadable interruption in its periphery, spreader means for widening said interruption and thereby force said base against the restraint of the housing element of said existing cover-supporting structure, and a cover keeper of sheet metal that is connected to and extends upwardly from the outer perimeter of the base, the improvement for increasing the resistance of the cover support to deformation which comprises:

a flanged outward top on said keeper, the resulting outward bend of said top being equipped with a succession of pressed-in gussets, the troughs of which slope with respect to the keeper.

8. The improvement according to claim 7 wherein the top of the keeper is flanged outward, then bends downward, and the resulting outward and downward bends are equipped with a succession of pressed-in gussets, the troughs of which slope with respect to the keeper.

9. The improvement according to claim 7 wherein the top of the keeper is flanged outward, then bends downward and then bends back toward the keeper to form a hollow wale wherein the outward and downward bends are equipped with a succession of pressed-in gussets, the troughs of which slope with respect to the keeper.

10. The improvement according to claim 7 wherein the cover support has a rectangular base.

11. The improvement according to claim 7 wherein the cover support has a split-ring base.

12. The improvement according to claim 7 wherein the cover support has a segmented ring base.

13. In a manhole cover support adapted to raise the level of a manhole cover from a position of retention by a cover seat element and a housing element of an existing manhole cover-supporting structure to a new and higher level and there retaining it, the manhole cover support comprising a base that is adapted to fit into the housing element of the existing cover-supporting structure, said base having a top that is substantially in one plane for support of the cover, a bottom therebelow that is in another plane, and a cover keeper connected to the perimeter of the base which forms a wall that extends upwardly from the outer perimeter of the base, the improvement for increasing the resistance of the cover support to deformation which comprises:

forming a succession of pressed out gussets in said cover keeper wall or a portion thereof.

14. The improvement according to claim 13 wherein the pressed out gussets run the entire vertical length of said keeper wall.

15. The improvement according to claim 13 wherein the pressed out gussets run only a portion of the vertical length of said keeper wall.

16. The improvement according to claim 13 wherein said gussets are pressed out in the form of a dovetail.

17. The improvement according to claim 16 wherein the dovetail gusset has been flattened.

18. The improvement according to claim 16 wherein only a portion of said dovetail gusset has been flattened.

* * * * *